US005524520A

United States Patent [19]

Brögger

[11] Patent Number: 5,524,520

[45] Date of Patent: Jun. 11, 1996

[54] BRICCIALDI B FLAT THUMB KEY MECHANISM FOR A WOODWIND INSTRUMENT

[76] Inventor: Johan Brögger, Stoltenbergsgade 1, 1576 Copenhagen V, Denmark

[21] Appl. No.: 241,979

[22] Filed: May 12, 1994

[51] Int. Cl.[6] ..... G10D 7/00

[52] U.S. Cl. ..... 84/380 R; 84/384

[58] Field of Search ..... 84/380 R, 382, 84/384

[56] References Cited

U.S. PATENT DOCUMENTS

| | | | |
|---|---|---|---|
| 4,376,403 | 3/1983 | Haedrich et al. | 84/384 |
| 4,798,120 | 1/1989 | Brögger | 84/380 R |

OTHER PUBLICATIONS

Theobald Boehm The Flute And Flute–Playing, pp. 84–86.

Nancy Toff The Development Of The Modern Flute, 1979, p. 73.

Richard Shepherd Rockstro (2nd Edition, 1928, pp. 376–377) A Treatise Of The Construction The History And The Practice Of the Flute.

*Primary Examiner*—Patrick J. Stanzione

*Attorney, Agent, or Firm*—Anderson Kill Olick & Oshinsky

[57] ABSTRACT

A Briccialdi B flat thumb key mechanism for a woodwind instrument having a B key including a cup part and a lever part and movable around an axle, and a lever rockingly movable around the same axle for transferring a rocking motion to the B key for closing same and to a B flat key also for closing same, with the axle defining an angle of 20°–75° relative to a longitudinal axis of the instrument.

8 Claims, 2 Drawing Sheets

Fig. 2
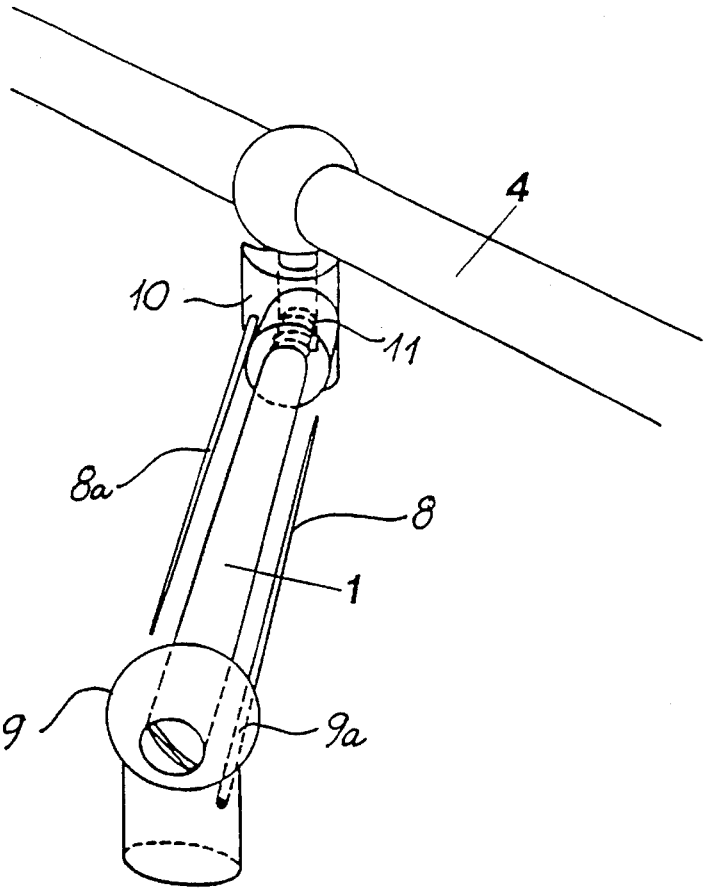
Fig. 3
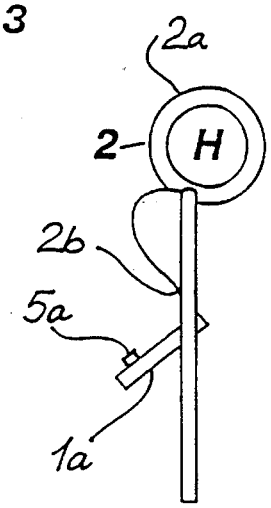
Fig. 4
Fig. 5
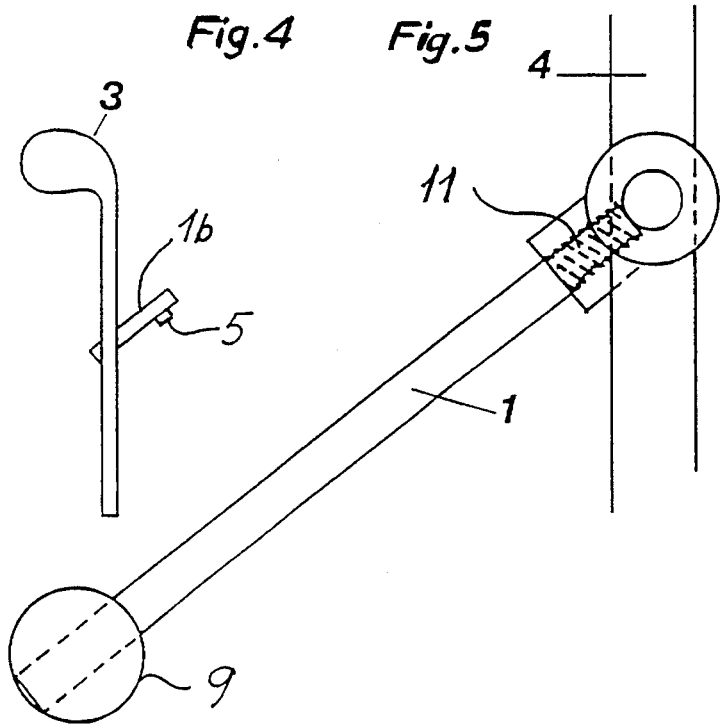

BRICCIALDI B FLAT THUMB KEY MECHANISM FOR A WOODWIND INSTRUMENT

BACKGROUND OF THE INVENTION

1. Field of the Invention

The present invention relates to a thumb double key, commonly called a Briccialdi B/B flat mechanism, in other words a mechanism operating the tones B and B flat, for a woodwind instrument, such as a flute or piccolo. Such a mechanism comprises a B key comprising a cup part and a lever part, the B key being rockingly movable around an axle, and a lever rockingly movable around the same axle and capable of transferring the rocking motion to the B key so as to close the B key and at the same time to a B flat key so as to close the B flat key.

2. Description of the Prior Art

The known Briccialdi B/B flat thumb key or lever mechanism is designed such that the rocking motion of the double key takes place by means of two charnier tubes mounted on an axle which is arranged at right angles to the longitudinal axis of the instrument.

The transmission of the rocking motion of the double key to the B-flat key on the main axle is effected by means of a simple system of levers between the back-connecting levers of the said keys.

The Briccialdi B flat thumb key mechanism consists of the two levers arranged parallelly at right angles to the above-mentioned longitudinal axle. The B key function applies to one of the levers. The other lever arranged above the B key but on the same axle acts such that any pressure on this lever causes a simultaneous closure of the B flat key on the main axle by means of the above-mentioned back-connecting levers. The springs of the mechanism are flat springs attached to the levers. The flat springs are arranged in the longitudinal direction of the levers and slide on the surface of the instrument tube which is normally made of a noble metal. The pressure exerted by the springs on the tube determines how fast the rocking motion of the levers can get.

This known design incurs a number of disadvantages, especially friction, less than optimal stability and slackness in the function of the key. Thus, the geometrical conformation of the flat springs attached to the levers is not optimal to their purpose, and it is known that there can be significant friction between the ends of the springs and the surface of the instrument tube on which they slide. This non-optimal conformation with a sliding movement and the friction caused hereby therefore limit how fast the rocking motion of the levers can get and thereby limit the artistic freedom of the musician. Furthermore, the difference in the action between the flat springs of the conventional Briccialdi double key and the needle springs used at all other keys gives an undesired difference in the tactile action between the Briccialdi keys and all other keys and thereby an unevenness in the tactile feel of the instrument as a whole.

SUMMARY OF THE INVENTION

The present invention avoids the above disadvantages and provides further important improvement, resulting in a more suitable and durable and more harmonious instrument having a higher degree of adaption to the anatomy of the human hand.

The B/B flat mechanism according to the invention is of the above-discussed Briccialdi type having a B key (2) comprising a cup part and a lever part, the B key being rockingly movable around an axle (1), and a lever (3) rockingly movable around the same axle (1) and capable of transferring the rocking motion to the B key so as to close the B key and at the same time to a B flat key so as to close the B flat key, and it is characterized in that the axle (1) defines an angle of 20°–75° relative to the longitudinal axis of the instrument.

The angle is normally in the interval of 30°–70°, preferably 40°–60°, relative to the longitudinal axis of the instrument. The fact that the thumb key axle defines the above-mentioned angle with the longitudinal axis of the middle piece makes it possible to obtain an almost double length of the charnier tubes compared to the conventional arrangement, thereby very considerably stabilizing the rocking motion against slack or play. Another important advantage is that the rocking rotation of the key and the lever around the axle will have a considerable component in the longitudinal direction of the instrument, thereby having an action which is closer to the action of the other keys of the instrument which all rotate around an axis substantially parallel to the axis of the instrument. This also makes the interaction between the musician's thumb and the key much more harmonious from an anatomic point of view compared to the conventional mechanism where the rotation is strictly perpendicular to the longitudinal axis of the instrument.

At the same time, the increased length of the charniers made possible because of the angle permits the use of needle springs instead of flat springs, thereby eliminating the above-mentioned problems with friction and unsuitable spring conformation and providing a faster action and an action which is of the same tactile feel as the action of the other keys of the instrument, thereby greatly contributing to harmony of the instrument.

The fact that the two charnier tubes of the levers can be considerably longer than in the conventional construction results in a longer support surface and thereby increased stability and reduced wear of the mechanism.

A very interesting interval of the above-mentioned angle is 47° to 57°, e.g. about 52°, as this provides optimum passages for needle springs. Instruments built with such angles have been found to have a superior function from all points of view.

In conformity with normal design of the Briccialdi mechanism, the B flat key in the mechanism according to the invention is suitably arranged on the main longitudinal axle of the instrument, and the rocking movement is transferred from the lever to the B flat key via a lever arranged on the main longitudinal axle of the instrument. Also, the lever arranged above the B key is suitably is arranged substantially parallel to the longitudinal direction of the instrument and to the lever part of the B key.

A further advantage with respect to the stability of the mechanism of the instrument is obtained when the thumb key axle is arranged so that it fixes the trill key axle (4) of the instrument, e.g. by means of its thread.

BRIEF DESCRIPTION OF THE DRAWINGS

In the following, a B/B flat mechanism for a flute or piccolo according to the invention is described with reference to the drawings in which FIG. 2 shows essential parts of the characteristic embodiment of the mechanism of the invention, FIG. 3 shows a B key;

FIG. 4 shows a B flat lever; and

FIG. 5 shows fixation of the trill key axle with a thumb key axle according to another embodiment of the invention.

DETAILED DESCRIPTION OF THE PREFERRED EMBODIMENTS

Figure 1:
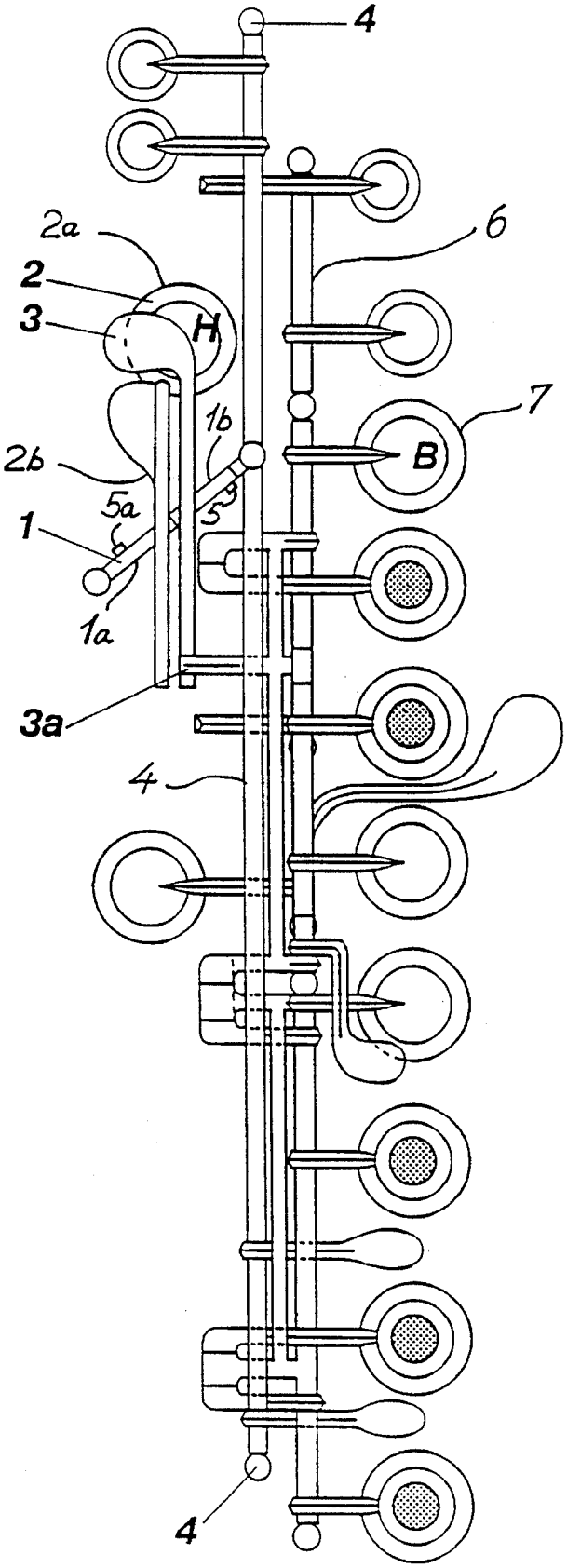
FIG. 1 shows a mechanism with a construction principle according to the present invention.

The mechanism shown in the drawings consists of a diagonally arranged B/B flat key axle (1) in FIG. 1, with a lever 2*b* of the B key 2 and the B flat lever 3 mounted on the axle (1) by means of charniers 1*a* and 1*b*, respectively. 5 and 5*a* designate catches for needle springs. 6 designates the main axle of the instrument, carrying a lever 3*a* which is actuated by the lever 3. 4 designates the ends of a trill axle of the instrument.

In operation, the B key 2 (designated H) is closed by depressing the lever 2*b*. The charnier 1*a* of the lever 2*b* of the B key 2 will thereby rock (rotate) around the axle 1. Due to the relatively great length of the charnier, the movement will be smooth and stable. The charnier is spring-loaded by means of a needle spring (not shown in FIG. 1, but apparent as 8 in FIG. 2) one end of which engages with the catch 5*a*. The lever 3, when depressed, will transfer its movement to a cup 2*a* of the key 2, thereby closing the B key 2. At the same time, the lever 3 will actuate the closure of the B flat key 7, designated B, through a lever 3*a* attached to the main longitudinal axle of the instrument.

FIG. 2 shows a detail of the mechanism in enlarged scale. 9 designates an exterior post 9 of the axle 1, and 10 designates in inner post 10 fixing the axle 1 and at the same time fixing the trill key axle 4 through its thread 11. Needles 8 and 8*a* are mounted in the interior post 10 and the exterior post 9 (as shown at 9*a*) respectively.

FIGS. 3 and 4 show the B key and the B lever separately.

FIG. 5 shows the fixation of the trill axle 4 with the flat key axle 1 according to another embodiment of the invention.

I claim:

1. A Briccialdi B flat thumb key mechanism for a woodwind instrument having a B key (2) comprising a cup part and a lever part, the B key being rockingly movable around an axle (1) and a lever (3) rockingly movable around the axle (1), and capable of transfering a rocking motion to the B key so as to close the B key and at the same time to a B flat key so as to close the B flat key, wherein the axle (1) defines an angle of 20°–75° relative to a longitudinal axis of the instrument.

2. A Briccialdi B flat thumb key mechanism according to claim 1, wherein the B flat key is arranged on a main longitudinal axle of the instrument, and the rocking movement is transferred from the lever (3) to the B flat key via a lever (3*a*) arranged on the main longitudinal axle of the instrument.

3. A Briccialdi B flat thumb key mechanism according to claim 1, wherein the lever (3) is arranged substantially parallel to the longitudinal axis of the instrument and to the lever part of the B key (2).

4. A Briccialdi B flat thumb key mechanism according to claim 1, wherein the mechanism comprises needle springs.

5. A Briccialdi B flat thumb key mechanism according to claim 1 wherein the axle (1) defines an angle of 30°–70° relative to the longitudinal axis of the instrument.

6. A Briccialdi B flat thumb key mechanism according to claim 5, wherein the axle (1) defines an angle of 47°–57° relative to the longitudinal axis of the instrument.

7. A Briccialdi B flat thumb key mechanism according to claim 1, wherein the axle (1) fixes a trill key axle (4) of the instrument by means of a thread thereof.

8. A Briccialdi B flat thumb key mechanism according to claim 5, wherein the axle defines an angle of 40°–60° relative to the longitudinal axis of the instrument.

* * * * *